US005413305A

United States Patent [19]

Leeb

[11] Patent Number: 5,413,305

[45] Date of Patent: May 9, 1995

[54] LIGHTWEIGHT COLLAPSIBLE BOOK STAND

[75] Inventor: Joseph Leeb, Upper Saddle River, N.J.

[73] Assignee: Joseph Leeb Enterprises, Inc., Upper Saddle River, N.J.

[21] Appl. No.: 99,224

[22] Filed: Jul. 29, 1993

[51] Int. Cl.[6] ..... A47B 97/04

[52] U.S. Cl. ..... 248/460; 248/450; 248/459

[58] Field of Search ..... 248/441.1, 459, 460, 248/450; 281/45

[56] References Cited

U.S. PATENT DOCUMENTS

| | | | |
|---|---|---|---|
| 2,625,408 | 1/1953 | Hirsch | 281/45 X |
| 2,698,493 | 1/1955 | Nichols | 248/459 X |
| 2,889,036 | 6/1959 | Davies | 248/441.1 X |
| 3,410,516 | 11/1968 | Criswell | 248/459 |
| 4,544,123 | 10/1985 | Peacock | 248/460 |
| 4,607,817 | 8/1986 | Aquino | 248/459 |
| 4,709,895 | 12/1987 | Mardak | 248/460 |
| 5,029,797 | 7/1991 | Levorchick | 248/459 |

*Primary Examiner*—J. Franklin Foss

*Attorney, Agent, or Firm*—Amster, Rothstein & Ebenstein

[57] ABSTRACT

A lightweight collapsible stand for books and the like includes a strip of substantially rigid material defining a front major panel, a back major panel secured to the front major panel by a foldline, a bottom panel secured to the front major panel by a foldline, and a securing flap secured to the back major panel by a foldline. The strip is movable between use and storage orientations, in the use orientation the major panels defining the sides of a triangle and the bottom panel and the securing flap cooperatively defining the base of the triangle, and in the storage orientation the major panels being parallel and the bottom panel overlying the back major panel. The stand also includes releasable fasteners disposed on the securing flap and the bottom panel for cooperatively securing them together in the use orientation, and releasable fasteners disposed on the bottom panel and the back major panel for cooperatively securing them together in the storage orientation.

5 Claims, 4 Drawing Sheets

FIG. 3
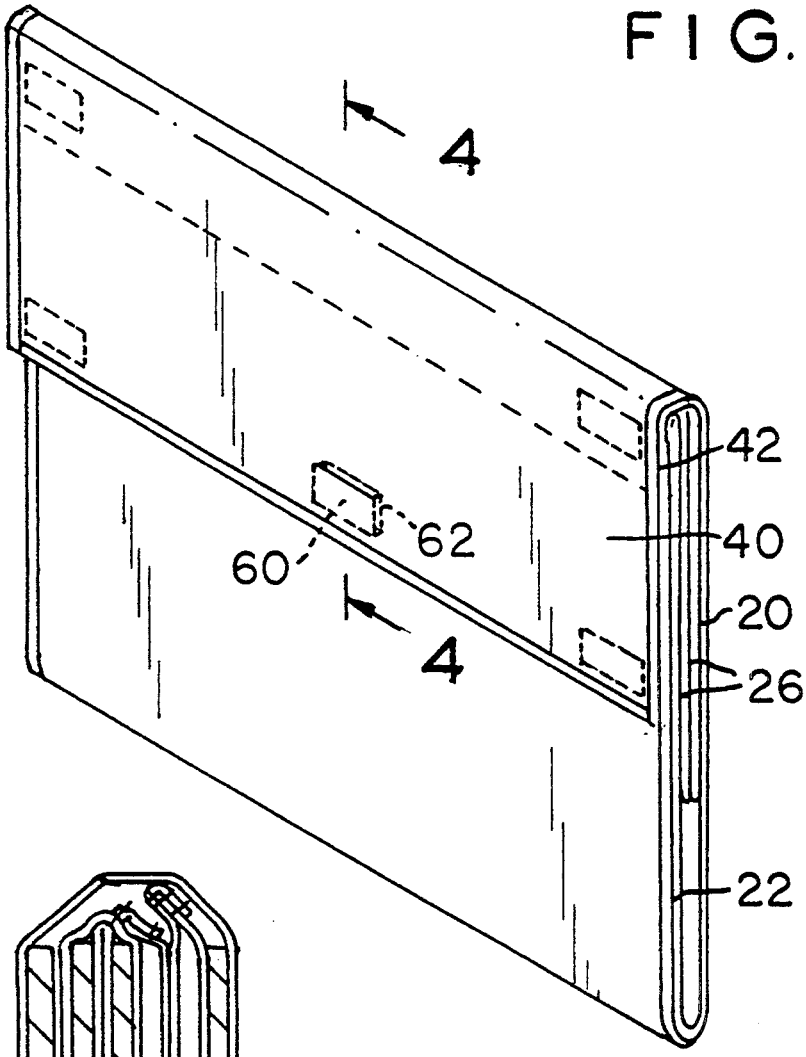
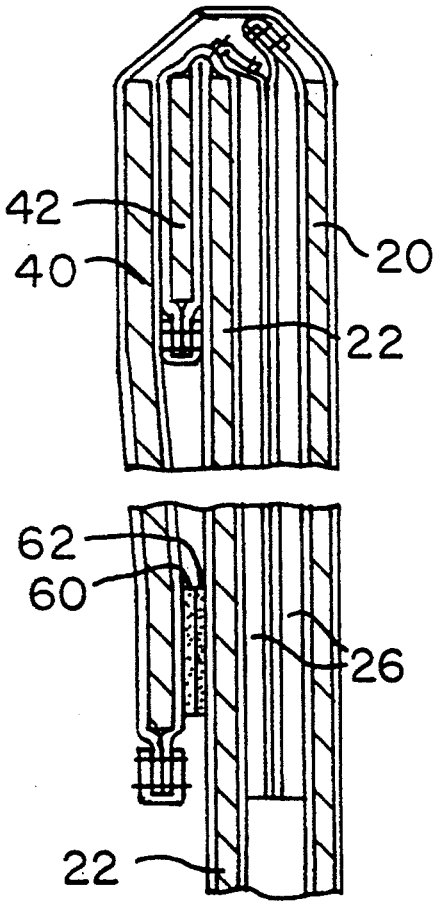
FIG. 4

FIG. 7
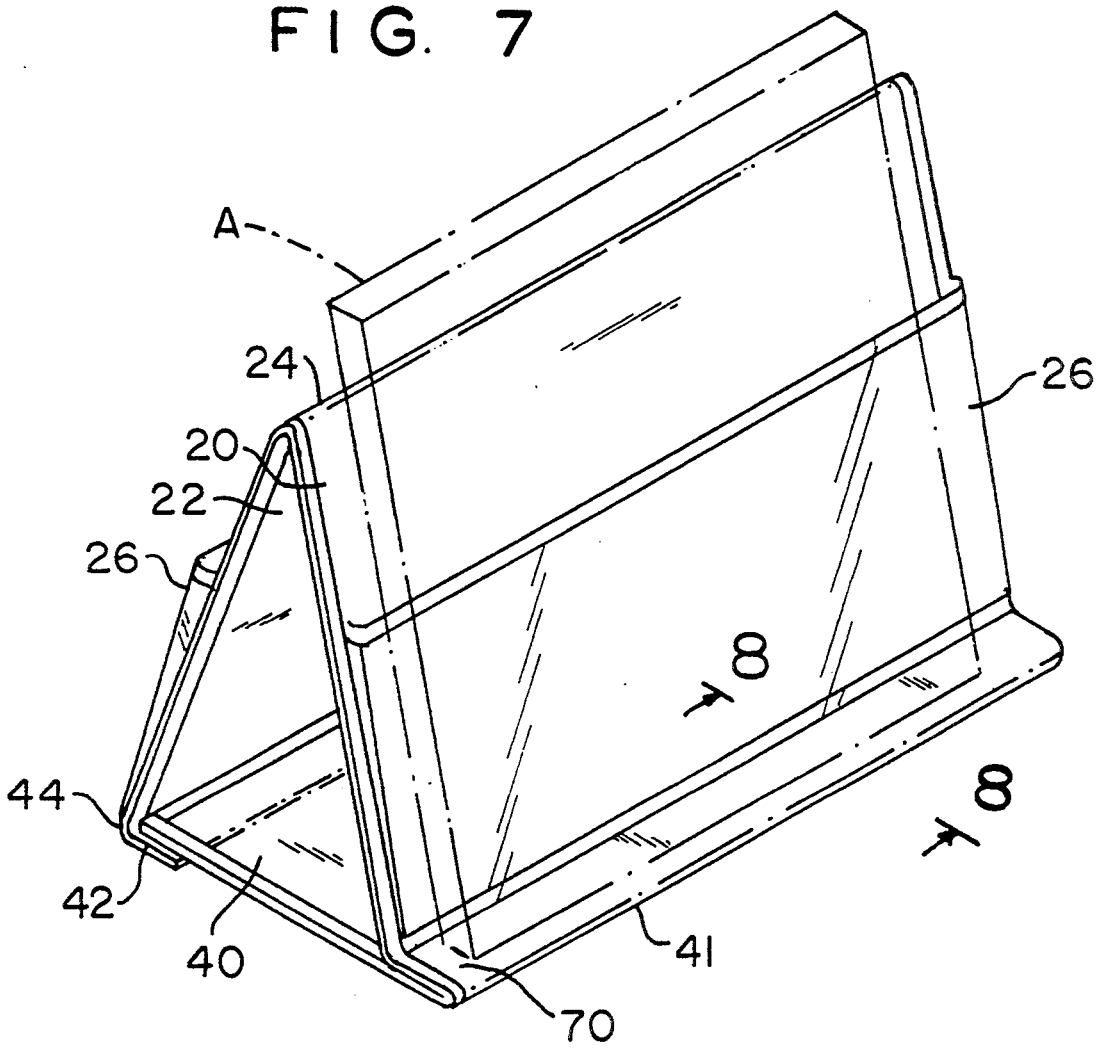
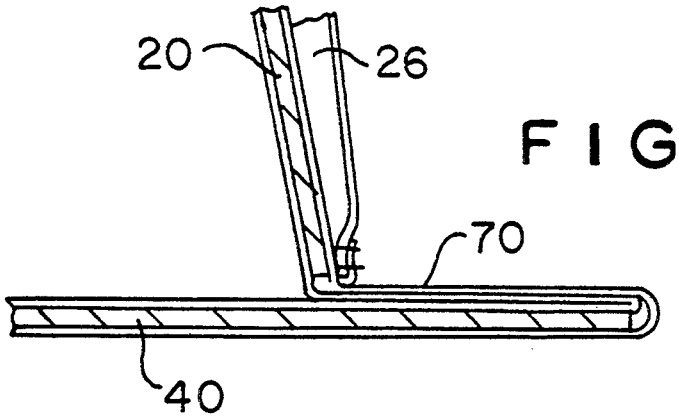
FIG. 8

LIGHTWEIGHT COLLAPSIBLE BOOK STAND

BACKGROUND OF THE INVENTION

The present invention relates to a lightweight collapsible stand, and more particularly to a lightweight collapsible stand for supporting books and the like in a suitable orientation for viewing.

It is well known to provide a book stand for supporting a book or other articles in a convenient position for viewing so that, for example, an individual may use the stand to maintain a book at a convenient angle for reading while leaving his hands free. Similarly, a retail store may use a stand to display its merchandise at a convenient angle for viewing by a potential customer.

Typically stands are triangular in configuration. Where the triangle is a right triangle, the book or other article is supported on the hypotenuse at the desired angle. Where the triangle is an isosceles triangle, either or both of the two equal length sides may be used for supporting the article. The stands may be solid or hollow, as desired, provided that they have sufficient strength to support the articles to be used therewith. For many applications, the weight and bulk of the stand is not an issue as the stand will rarely, if ever, be moved from one location to another or be supported on anything other than a sturdy base.

However, for other applications the weight and bulk of the stand is of considerably significance. For example, an individual may wish to carry the stand with him from one location to another on a frequent basis. In this situation he weight and bulk of a conventional stand may be unsatisfactory. While collapsible stands are not unknown, such stands typically cannot releasably lock into both the use orientation and the storage orientation so that they neither accidentally open during transport nor accidentally collapse during use.

The conventional stand is intended to be placed on a support or base, such as a table, with the bottom edge of the book or other article resting on the base and bearing a substantial portion of the weight thereof. Again, while this is satisfactory in most instances, on occasion a satisfactory base may not be available. For example, the stand may be supported on a lawn where the use of grass as the base might stain the article and/or might not provide a suitable coefficient of friction to prevent the article from sliding off the stand. Or a table which is used as the base may be so dirty that the article itself would be dirtied by contact therewith.

Accordingly, an object of the present invention is to provide a lightweight, collapsible stand for books and other articles.

Another object is to provide such a stand which releasably locks in both the use and storage orientations.

A further object is to provide such a stand which in one embodiment, if desired, provides a ledge on which to rest the article so that it does not contact the stand support.

SUMMARY OF THE INVENTION

It has now been found that the above and related objects of the present invention are obtained in a lightweight collapsible stand for books and the like. The stand comprises a strip of substantially rigid material defining a front major panel, a back major panel secured to the front major panel by a foldline, a bottom panel secured to the front major panel by a foldline, and a securing flap secured to the back major panel by a foldline. The strip is movable between use and storage orientations. In the use orientation, the major panels define the sides of a triangle, and the bottom panel and the securing flap cooperatively define the base of the triangle. In the storage orientation the major panels are parallel, and the bottom panel overlies the back major panel. Releasable securing means are disposed on the securing flap and the bottom panel for cooperatively securing the securing flap and the bottom panel together in the use orientation. Releasable securing means are also disposed on the bottom panel and the back major panel for cooperatively securing the bottom panel and the back major panel together in the storage orientation.

The strip in the use orientation preferably defines on the outer surfaces of the front and back major panels transparent means for releasably securing an article thereon. In the use and modified orientations, the major panels define the generally equal length sides of an isosceles triangle.

In one preferred embodiment, the bottom panel includes a flexible section of substantially flexible material adjacent the front major panel, the flexible section acting as the foldline between the bottom panel and the front major panel. The strip is movable among the storage orientation, the use orientation and a modified use orientation wherein the major panels define the sides of a triangle, the bottom panel and securing flap cooperatively define the base of the triangle, and the flexible section defines a protruding ledge coplanar with the triangle base and adapted to receive and support an article. The flexible section preferably defines a surface for supporting an article thereon against slippage.

BRIEF DESCRIPTION OF THE DRAWING

The above and related objects, features, and advantages of the present invention will be more fully understood by reference to the following detailed description of the presently preferred, albeit illustrative, embodiments of the present invention when taken in conjunction with the accompanying drawing wherein:

FIG. 3 is an isometric view of the stand in the storage orientation;

FIG. 4 is a fragmentary sectional view thereof to a greatly enlarged scale taken along the line 4—4 of FIG. 3;

FIG. 7 is an isometric view of the stand in the modified use orientation, with an article used therewith illustrated in phantom line; and FIG. 8 is a fragmentary sectional view thereof to a greatly enlarged scale taken along the line 8—8 of FIG. 7.

DETAILED DESCRIPTION OF THE PREFERRED EMBODIMENTS

Figure 1:
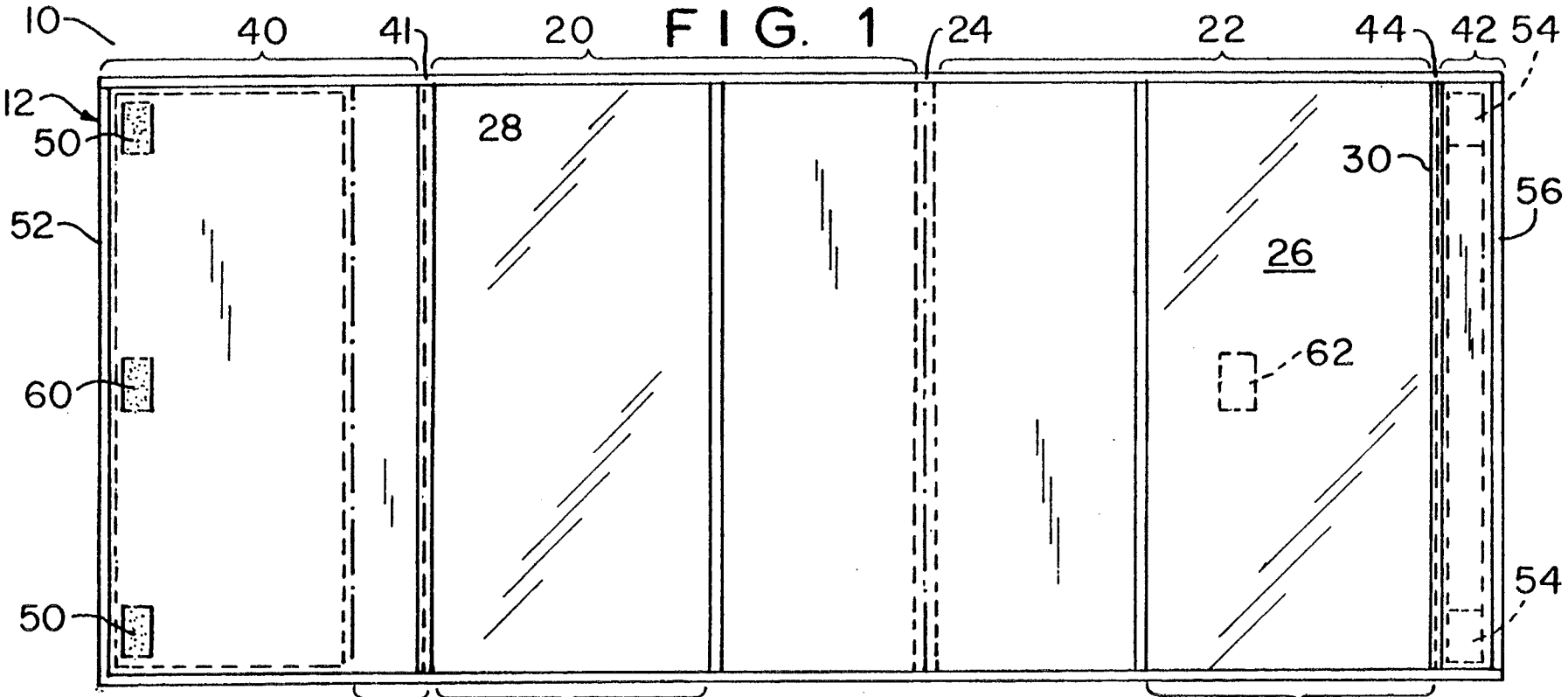
FIG. 1 is a top plan view of the stand when laid out flat.
Figure 2:
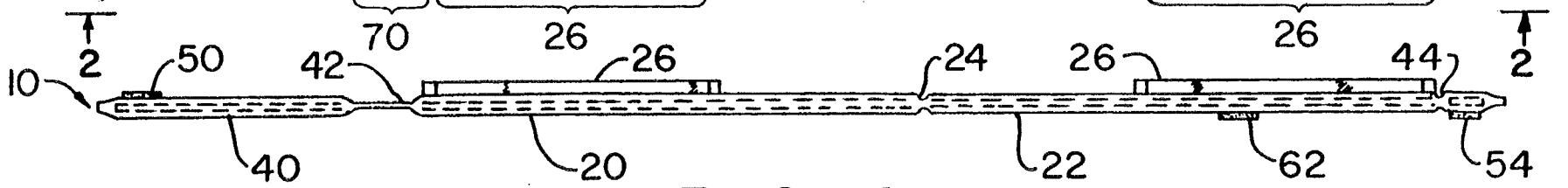
FIG. 2 is a side elevational view thereof taken along the line 2—2 of FIG. 1.
Figure 5:
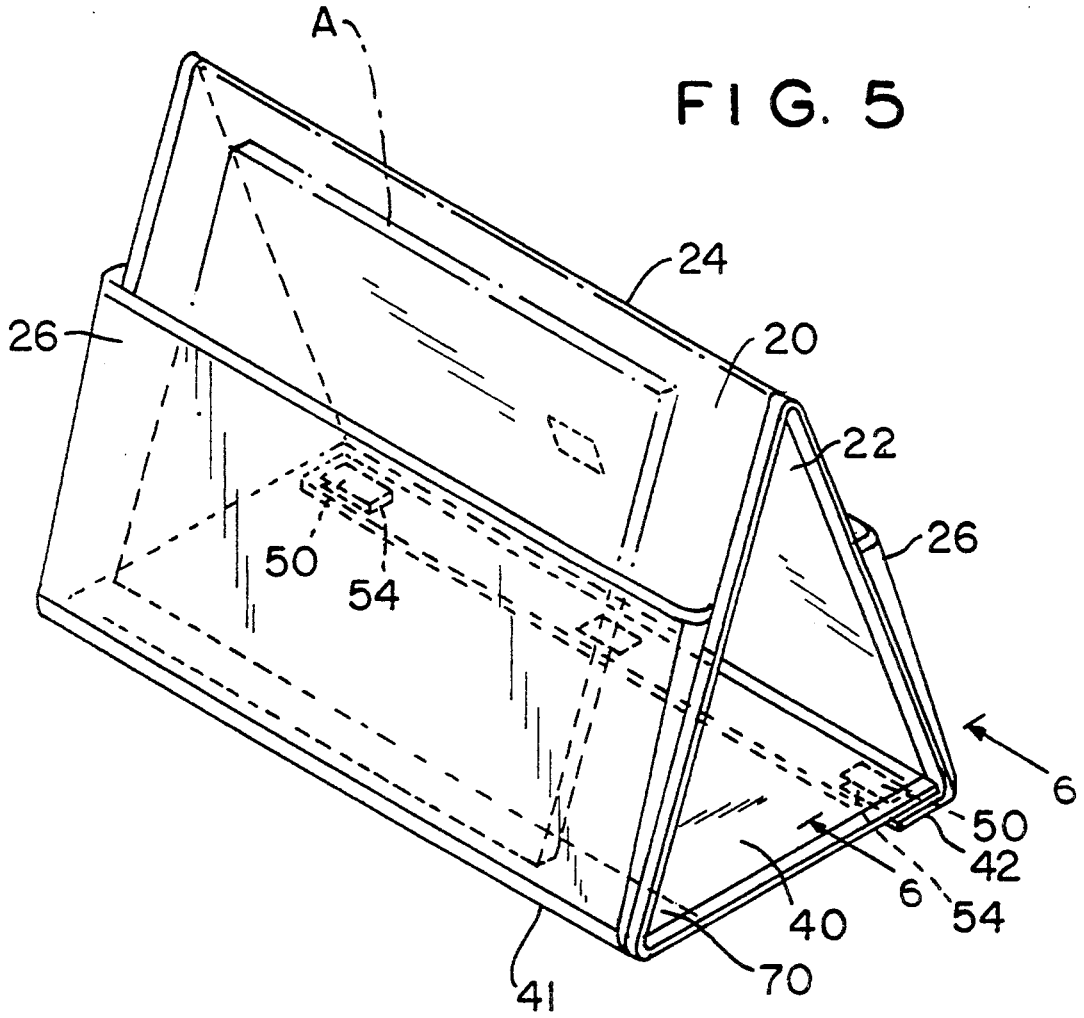
FIG. 5 is an isometric view of the stand in the use orientation, with an article used therewith illustrated in phantom line.
Figure 6:
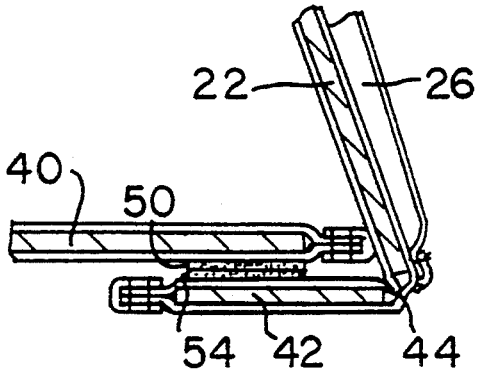
FIG. 6 is a fragmentary sectional view thereof to a greatly enlarged scale taken along the line 6—6 of FIG. 5.

Referring now to the drawing and in particular to FIGS. 1 and 2 thereof, therein illustrated in a lightweight collapsible stand according to the present invention, generally designated by the reference numeral 10. The stand is illustrated in a coplanar or laid out configuration and is capable of assuming a storage or transport orientation (as illustrated in FIGS. 3 and 4), a use orientation (as illustrated in FIGS. 5 and 6) and, in a preferred embodiment, a modified use orientation (as illustrated in FIGS. 7 and 8).

The stand 10 comprises a strip of substantially rigid material generally designated 12. It is conveniently formed of two layers of a plastic sheet sewn or heat sealed together with a plurality of cardboard stiffeners therebetween. At the spaces between the cardboard stiffeners, the strip 12 defines foldlines. Plastic outer surfaces are preferred so that the stand is easy to clean, although other materials may be employed.

The strip 12 defines a front major panel 20 and a back major panel 22 secured to the front major panel 20 by a foldline 24. The front and back major panels 20, 22 are generally of like configuration and dimensions, both being illustrated as rectangular. In order to enable thin books, magazines, and the like to be releasably secured to the front and back major panels 20, 22, each is provided at an end remote from the foldline 24 with transparent means for releasably securing an article thereto 26. The transparent means 26 is preferably a relatively strong cellophane or plastic strip secured to the respective major panel 20, 22 at the sides thereof and at the respective ends 28, 30 thereof remote from the foldline 24. The strip 12 additionally includes a bottom panel 40 secured to the front major panel 20 by a foldline 41 and a securing flap 42 secured to the back major panel 22 by a foldline 44.

The stand 10 additionally includes releasable securing means or fasteners 50 disposed adjacent each side of the bottom panel 40 adjacent the free end 52 thereof, and a pair of releasable fasteners 54 disposed adjacent each side of the securing flap 42 adjacent the free end 56 thereof. As illustrated in FIG. 1, the fasteners 50 are disposed on the upper surface of bottom panel 40 and face upwardly, while the fasteners 54 are disposed on the lower surface of securing flap 42 and face downwardly. As will be further explained in connection with FIGS. 5 and 6, the fasteners 50, 54 are used for cooperatively securing the bottom panel 40 and the securing flap 42 together in the use orientation illustrated therein. The stand additionally includes a releasable securing means or fastener 60 disposed on the bottom panel 40 adjacent the free end 52 thereof and intermediate the fasteners 50, and a fastener 62 disposed on the back major panel 22. As illustrated, the fastener 60 is disposed on the upper surface of the strip 12 and faces upwardly, while the fastener 62 is disposed on the lower surface of the strip 12 and faces downwardly. As will be explained further in connection with FIGS. 3 and 4, the fasteners 60, 62 are used for cooperatively securing the bottom panel 40 and the back major panel 22 together in the storage orientation illustrated therein.

Still referring to FIGS. 1 and 2, in a preferred embodiment of the stand capable of assuming a modified use orientation, the bottom panel 40 includes a flexible section 70 of substantially flexible material adjacent the front major panel 20, the flexible section 70 acting inter alia as the foldline 42 between the bottom panel 40 and the front major panel 20.

As noted above, the strip 12 is movable among storage (and transport), use and modified use orientations. Referring now to FIGS. 3–4, in the storage orientation the major panels 20, 22 are parallel, while the bottom panel 40 overlies the back major panel 22, with fastener 60 of the bottom panel 40 releasably engaging aligned fastener 62 of the back major panel 22. As best seen in FIG. 4, in this compact and easy-to-carry storage and transport orientation the transparent means 26 overlap one another, thereby to reduce scratching thereof, and the securing flap 42 is disposed intermediate the bottom panel 40 and the back major panel 22.

Referring now to FIGS. 5 and 6, in the use orientation the major panels 20, 22 define two sides of a triangle, while the bottom panel 40 and the securing flap 42 cooperatively define the base of the triangle, with fasteners 50 of the bottom panel releasably engaging aligned fastener 54 of the securing flap 42. Typically the major panels 22, 24 are generally of equal length so that the triangle defined by the strip 12 is an isosceles triangle. In order to better illustrate the use of transparent means 26, an article A is illustrated in phantom line intermediate the front major panel 20 and its transparent means 26. The article may be a thin book or magazine. Where the article is a single sheet of paper, it may be read in its entirety either above or through the transparent means 26.

Referring now to FIGS. 7 and 8, in the modified use orientation the major panels 20, 22 of the preferred embodiment define the sides of a triangle, the bottom panel 40 and the securing flap 42 cooperatively define the base of the triangle (as in the use orientation of FIGS. 5 and 6), and the flexible section 40 defines a ledge 70 coplanar with the triangle base and protruding outwardly from the triangle. The ledge 70 is adapted to receive and support an article A illustrated in phantom line. It will be appreciated that in the modified use orientation the triangle formed by strip 12 remains an isosceles triangle, although the base thereof is somewhat reduced in size as a portion thereof now serves as the ledge 70 projecting outwardly from the triangle coplanar with the triangle base. Preferably the flexible section 70 has a relatively non-slip surface suitable for supporting an article (such as a book) thereon against slippage.

It will be appreciated that the fasteners 60, 62 are employed only when the strip is in the storage orientation, and not when the stand is in the use and modified use orientations. Similarly, the fasteners 50, 54 are employed only when the stand is in the use and modified use orientations, and not when the stand is in the storage orientation. The fasteners are preferably formed of the multi-component material available under the trade name VELCRO having one component defining a multitude of minihooks and a mating component defining a multitude of miniloops adapt to receive and releasably retain the minihooks. However a wide variety of conventional releasable fasteners may be used instead, such as snaps.

It will also be appreciated that while the transparent means 26 are on the outside of the stand, exposed and ready for use, in the use and modified use orientations, they are in a protected location when the stand is in the storage orientation.

To summarize, the present invention provides a lightweight collapsible stand for books and other articles which releasably locks in both the use and storage orientations. In a preferred embodiment, the stand provides a ledge on which to rest an article so it does not contact the support stand.

Now that the preferred embodiments of the present various invention have been shown and described in detail, modifications and improvements thereon will become readily apparent to those skilled in the art. Accordingly, the spirit and scope of the present invention is to be construed broadly and limited only by the appended claims, and not by the foregoing specification.

I claim:

1. A lightweight collapsible stand comprising:

(A) a strip of substantially rigid material defining:

(i) a front major panel, (ii) a back major panel secured to said front major panel by a foldline, (iii) a bottom panel secured to said front major panel by a foldline, said bottom panel including a flexible section of substantially flexible material adjacent said front major panel, said flexible section acting as the foldline between said bottom panel and said front major panel and defining a non-slip surface for supporting an article thereon against slippage, and (iv) a securing flap secured to said back major panel by a foldline;

said strip being movable between use and storage orientations, in said use orientation said major panels defining the sides of a triangle and said bottom panel and said securing flap cooperatively defining the base of the triangle, in said storage orientation said major panels being parallel and said bottom panel overlying said back major panel;

(B) releasable securing means disposed on said securing flap and said bottom panel for cooperatively securing said securing flap and said bottom panel together in said use orientation; and (C) releasable securing means disposed on said bottom panel and said back major panel for cooperatively securing said bottom panel and said back major panel together in said storage orientation.

2. The stand of claim 1 wherein said strip in said use orientation defines on the outer surfaces of said front and back major panels transparent means for releasably securing an article thereon.

3. The stand of claim 1 wherein said strip is movable among said storage orientation, said use orientation and a modified use orientation wherein said major panels define the sides of a triangle, said bottom panel and securing flap cooperatively define the base of the triangle, and said flexible section defines a protruding ledge coplanar with said triangle base and adapted to receive and support an article.

4. The stand of claim 1 wherein in said use and modified orientations said major panels define the generally equal length sides of an isosceles triangle.

5. A lightweight collapsible stand comprising:

(A) a strip defining:

(i) a front major panel of substantially rigid material, (ii) a back major panel of substantially rigid material secured to said front major panel by a foldline, (iii) a bottom panel of substantially rigid material secured to said front major panel, said bottom panel including a flexible section of substantially flexible material adjacent said front major panel, and (iv) a securing flap of substantially rigid material secured to said back major panel by a foldline;

said strip being movable among storage, use and modified use orientations, in said use orientation said major panels defining the sides of a triangle and said bottom panel, said flexible panel, and said securing flap cooperatively defining the base of the triangle, in said storage orientation said major panels being parallel and said bottom panel overlying said back major panel, in said modified use orientation said major panels defining the sides of a triangle, said bottom panel and said securing flap cooperatively defining the base of the triangle, and said flexible section defining a protruding non-slip ledge coplanar with said triangle base and adapted to receive and support reading material thereon against slippage;

(B) releasable securing means disposed on said securing flap and said bottom panel for cooperatively securing said securing flap and said bottom panel together in said use and modified use orientations; and (C) releasable securing means disposed on said bottom panel and said back major panel for cooperatively securing said bottom panel and said back major panel together in said storage orientation.

* * * * *